US009337601B2

(12) United States Patent
Silva et al.

(10) Patent No.: US 9,337,601 B2
(45) Date of Patent: May 10, 2016

(54) CHILD MONITORING SYSTEM

(71) Applicant: Cosco Management, Inc., Wilmington, DE (US)

(72) Inventors: Helena C Silva, Seekonk, MA (US); Roger J Babineau, Taunton, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/490,157

(22) Filed: Sep. 18, 2014

(65) Prior Publication Data

US 2015/0079809 A1 Mar. 19, 2015

Related U.S. Application Data

(60) Provisional application No. 61/879,999, filed on Sep. 19, 2013.

(51) Int. Cl.

| | |
|---|---|
| ***H01R 39/64*** | (2006.01) |
| ***H01R 39/00*** | (2006.01) |
| ***G08B 25/10*** | (2006.01) |
| ***G08B 21/22*** | (2006.01) |
| ***G08B 21/02*** | (2006.01) |
| *H01R 13/447* | (2006.01) |
| *H01R 103/00* | (2006.01) |
| *H01R 24/28* | (2011.01) |

(52) U.S. Cl.

CPC ..... *H01R 39/64* (2013.01); *G08B 21/0208* (2013.01); *H01R 13/447* (2013.01); *H01R 24/28* (2013.01); *H01R 2103/00* (2013.01)

(58) Field of Classification Search

CPC ..... H01R 35/04; H01R 39/64; H01R 23/025; H01R 39/00; G08B 25/10; G08B 21/0202; G08B 21/22; G08B 21/0208

See application file for complete search history.

(56) References Cited

U.S. PATENT DOCUMENTS

| | | | | |
|---|---|---|---|---|
| 5,210,532 | A | 5/1993 | Knoedler et al. | |
| D344,906 | S | 3/1994 | Abrams et al. | |
| D344,907 | S | 3/1994 | Abrams et al. | |
| D355,385 | S | 2/1995 | Abrams | |
| D365,562 | S | 12/1995 | Abrams | |
| 5,512,880 | A | 4/1996 | Abrams et al. | |
| 6,821,134 | B2 * | 11/2004 | Chen | H01R 35/04 439/11 |
| 7,098,785 | B2 | 8/2006 | Wong et al. | |
| 7,154,389 | B2 | 12/2006 | Marsden et al. | |
| 7,381,059 | B2 * | 6/2008 | Wong | H01R 35/04 439/131 |
| 7,696,888 | B2 | 4/2010 | Swan et al. | |
| 8,096,817 | B2 * | 1/2012 | Lee | H01R 35/04 439/104 |
| 2006/0019519 | A1 * | 1/2006 | Son | H01R 35/04 439/131 |
| 2007/0241911 | A1 * | 10/2007 | Swan | G08B 13/19621 340/573.1 |
| 2009/0227122 | A1 * | 9/2009 | Jubelirer | H01R 31/065 439/11 |
| 2010/0099327 | A1 * | 4/2010 | Binyamin | A63H 3/28 446/297 |
| 2010/0176942 | A1 * | 7/2010 | Stut | G08B 5/36 340/539.15 |
| 2012/0009807 | A1 * | 1/2012 | Kuo | H01R 24/30 439/131 |
| 2012/0032797 | A1 * | 2/2012 | Babineau | A61B 5/01 340/539.15 |
| 2013/0099921 | A1 * | 4/2013 | Stut | G08B 21/0202 340/539.15 |
| 2013/0278419 | A1 * | 10/2013 | D'Antonio | G08B 21/0202 340/539.15 |
| 2014/0192135 | A1 | 7/2014 | Babineau et al. | |
| 2014/0235079 | A1 * | 8/2014 | Wallace | H01R 35/04 439/131 |

* cited by examiner

*Primary Examiner* — Gary Paumen
(74) *Attorney, Agent, or Firm* — Barnes & Thornburg LLP

(57) ABSTRACT

A child monitoring system is provided for supervising a child from a remote location. The system includes a child-observation unit and a device for controlling the child-observation unit from a remote location.

13 Claims, 5 Drawing Sheets

CHILD MONITORING SYSTEM

PRIORITY CLAIM

Figure 1:
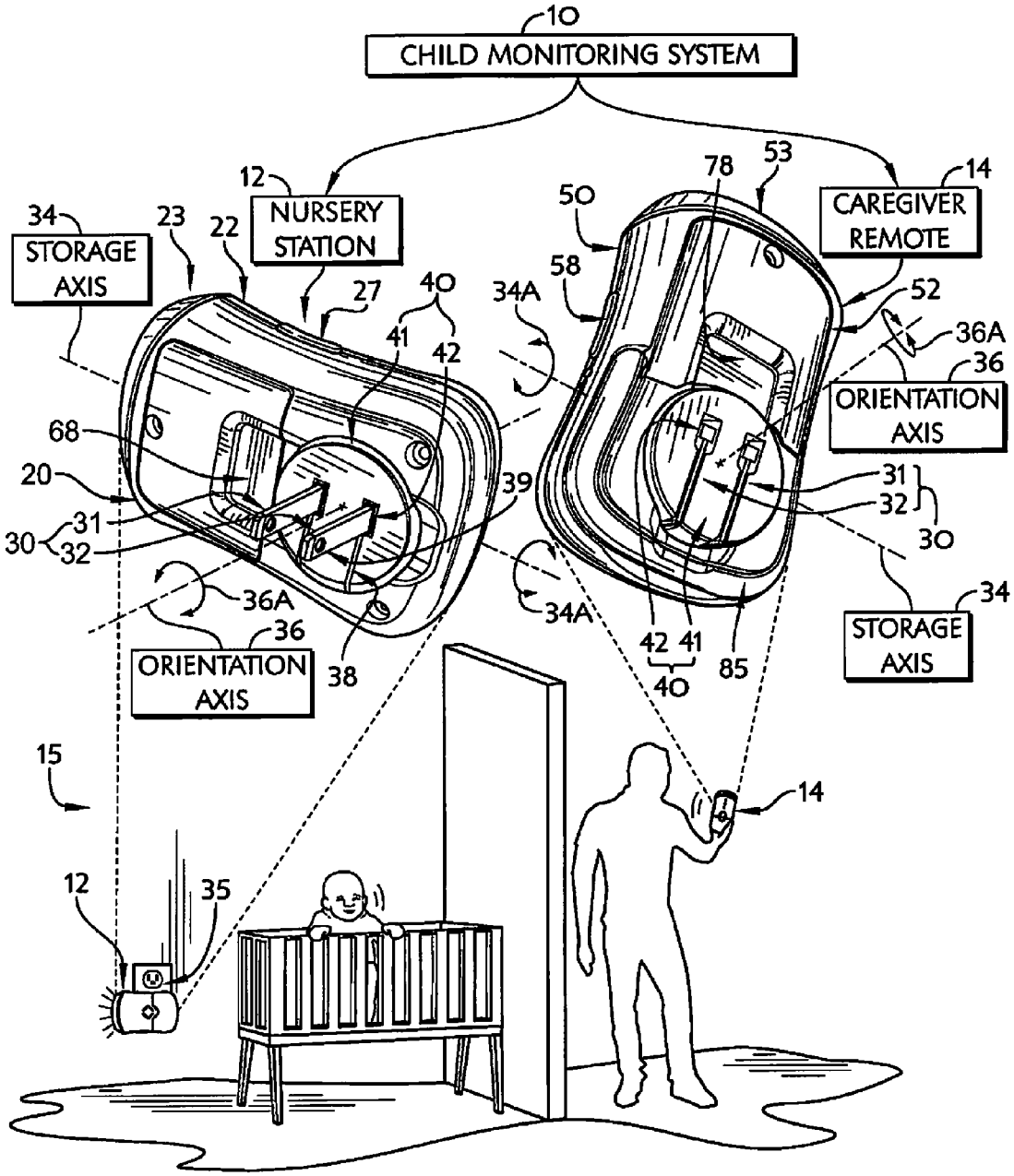

This application claims priority under 35 U.S.C. §119(e) to U.S. Provisional Application Ser. No. 61/879,999, filed Sep. 19, 2013, which is expressly incorporated by reference herein.

BACKGROUND

The present disclosure relates to child monitoring systems. More particularly, the present disclosure relates to child monitoring systems including a nursery station for detecting sounds in child's room and a caregiver remote for monitoring sounds detected by the nursery station.

SUMMARY

An illustrative child monitoring system for remotely supervising a child in a nursery includes a nursery station and a caregiver remote. The nursery station is adapted to be installed in a nursery to sense and transmit sounds from the nursery. The caregiver remote is adapted to be carried with a caregiver outside the nursery to receive and reproduce sounds sensed by the nursery station so that the caregiver can listen to a child in the nursery without entering nursery.

In illustrative embodiments, the nursery station includes a transmitter unit, power-receiver prongs, and a pivot hub interconnecting the transmitter unit with the power-receiver prongs. The transmitter unit is adapted to transmit sounds from a nursery in which it is placed. The power-receiver prongs are electrically coupled to the transmitter unit to power the transmitter unit when plugged into a wall socket. The pivot hub provides means for allowing rotation of the power-receiver prongs relative to the transmitter unit about a storage axis and about an orientation axis that extends perpendicular to the storage axis.

In illustrative embodiments, the caregiver remote includes a receiver unit, power-receiver prongs, and a pivot hub interconnecting the receiver unit and the power-receiver prongs. The receiver unit is adapted to receive and reproduce sounds transmitted by the transmitter unit of the nursery station. The power-receiver prongs are electrically coupled to the receiver unit to power or recharge the receiver unit when plugged into a wall socket. The pivot hub provides means for allowing rotation of the power-receiver prongs relative to the transmitter unit about a storage axis and about an orientation axis that extends perpendicular to the storage axis.

In illustrative embodiments, movement of the power-receiver prongs included in either the nursery station or the caregiver remote about the storage axis allows the power-receiver prongs to be moved from a storage position arranged in channels extending along the corresponding transmitter or receiver unit so that the power-receiver prongs are out of the way during transportation of the caregiver remote to a use position extending away from the transmitter unit so that the power-receiver prongs can be inserted into a wall socket. Movement of the power-receiver prongs included in either the nursery station or the caregiver remote about the orientation axis allows the power-receiver prongs to be moved from a longitudinally-oriented position, in which the power-receiver prongs support the corresponding transmitter or receiver unit when plugged into a first wall socket so that the transmitter unit covers an adjacent wall socket, to a laterally-oriented position, in which the power-receiver prongs support the transmitter unit when plugged into a first wall socket so that the transmitter unit uncovers an adjacent wall socket.

In illustrative embodiments, each pivot hub includes a rotor and a prong-support trunion coupled to the rotor. The rotor is coupled to a corresponding transmitter or receiver unit for movement about the orientation axis. The prong-support trunion is coupled to the rotor for movement about the storage axis and is coupled to the power receiver prongs so that the power receiver prongs pivot with the prong-support trunion about the storage axis.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figure 2:
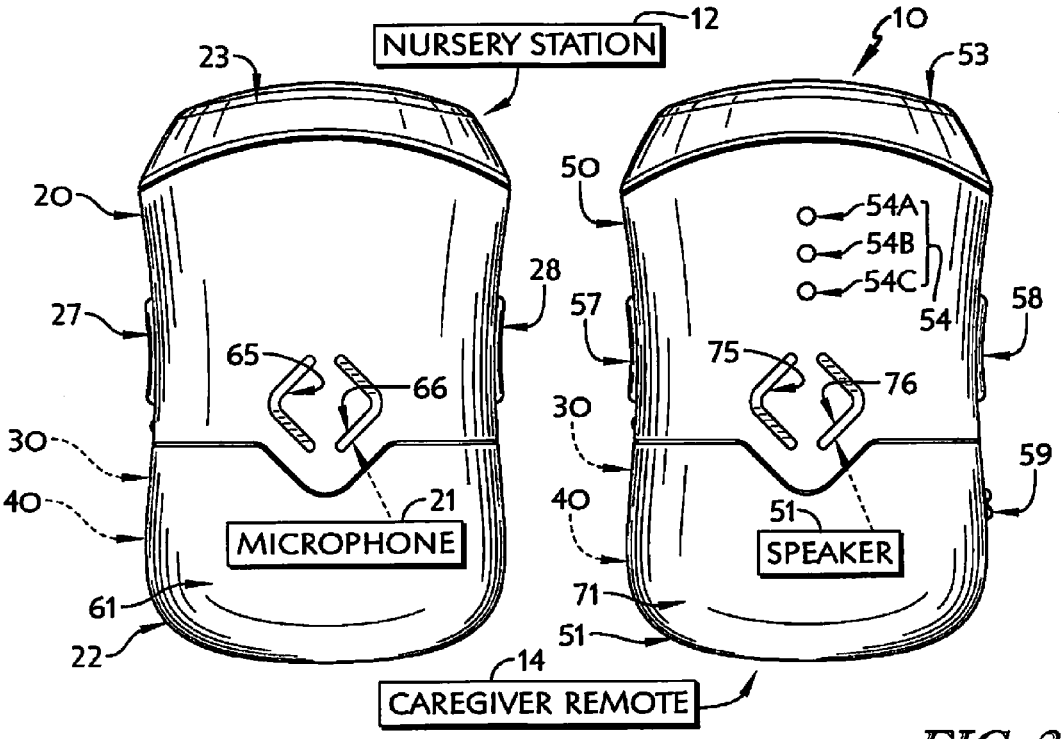
Figure 3:
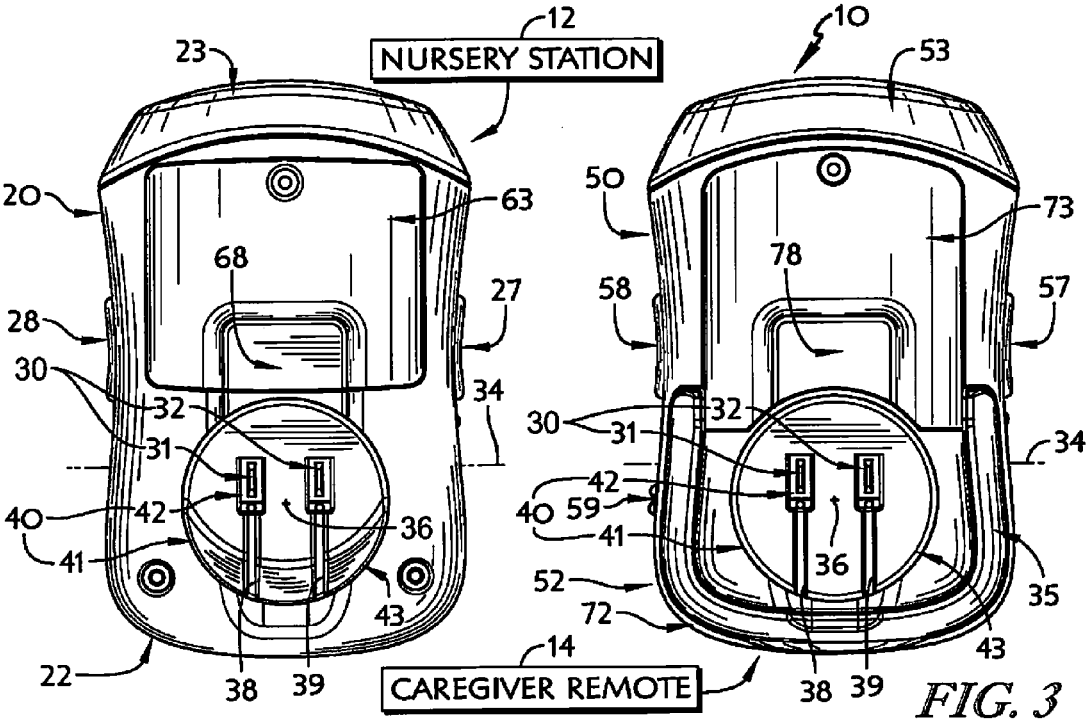
Figure 4:
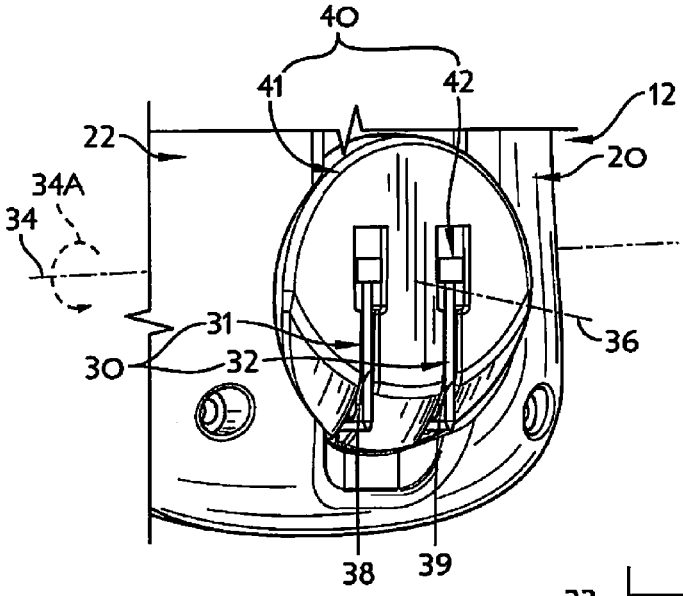
Figure 5:
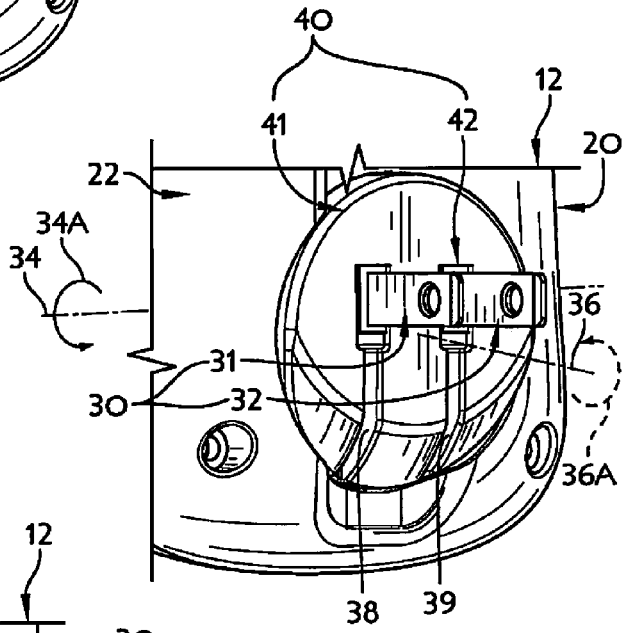
Figure 6:
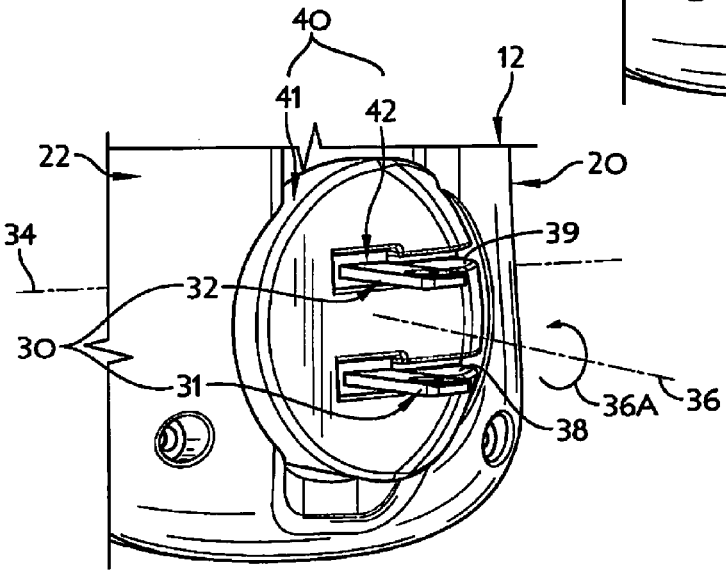
Figure 7:
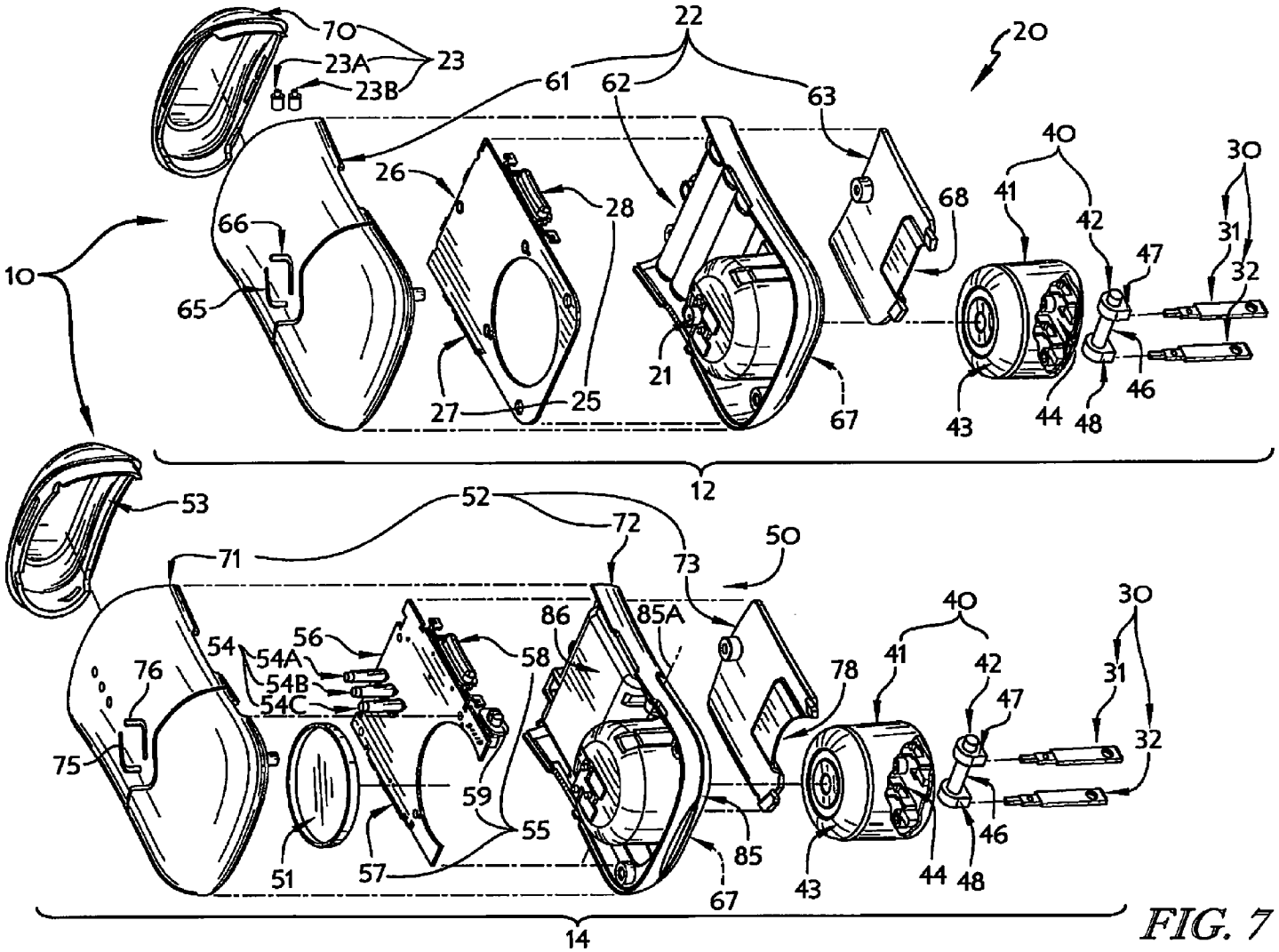
Figure 8:
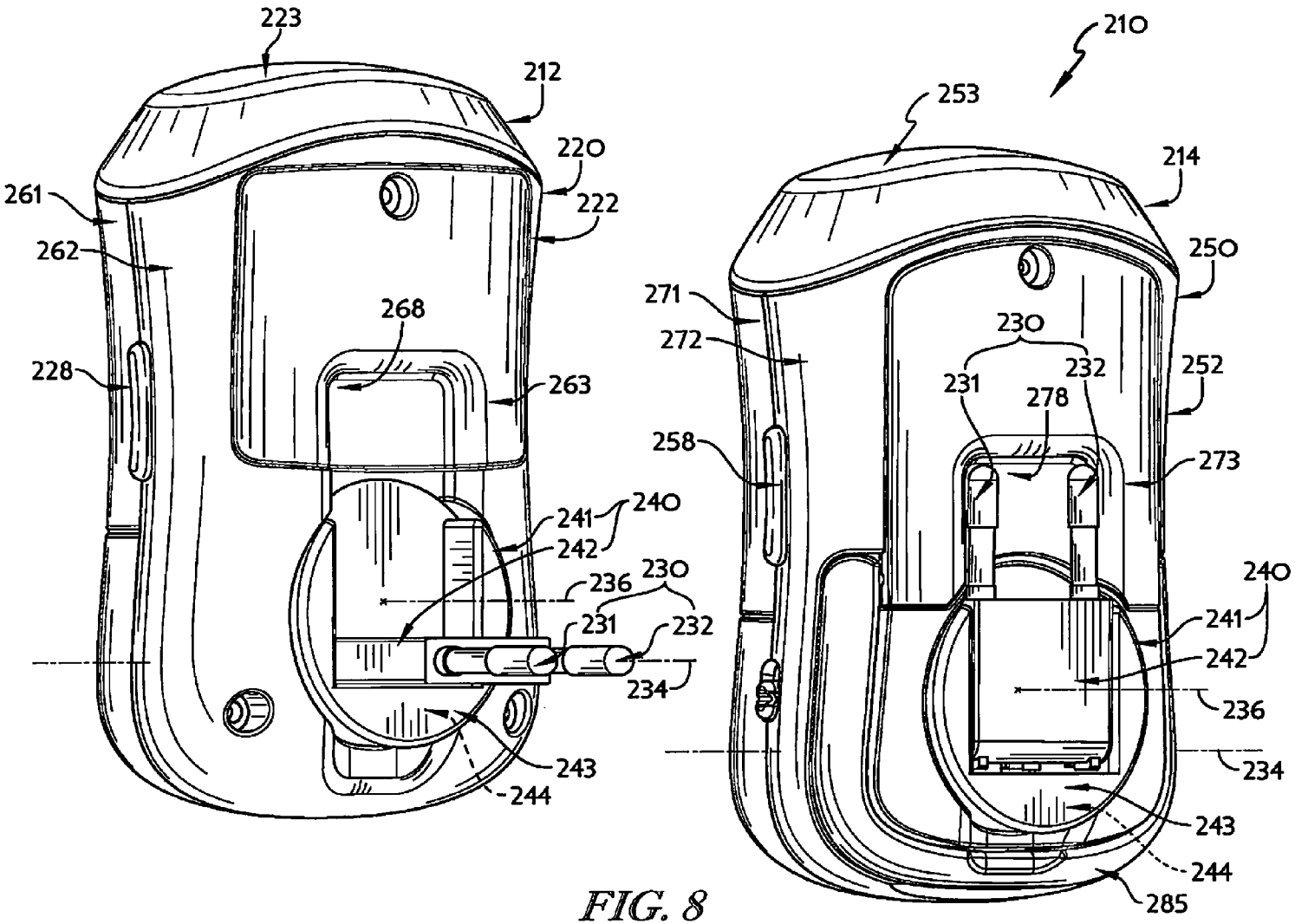

The detailed description particularly refers to the accompanying figures in which:

FIG. 1 is a perspective view of a child monitoring system including a nursery station adapted to be installed in a nursery to transmit sounds from the nursery and a caregiver remote adapted to be carried with a caregiver to receive sounds detected by the nursery station showing that the nursery station includes a transmitter unit adapted to transmit sounds from a child's room and a pair of power-receiver prongs adapted to plug into a wall outlet to power the transmitter unit, showing that the caregiver remote includes a receiver unit adapted to receive sounds from a the nursery station and a pair of power-receiver prongs adapted to plug into a wall outlet to power the receiver unit, and showing that each of the nursery station and the caregiver remote includes a pivot hub coupled between a corresponding transmitter/receiver unit and power-receiver prongs to allow the power-receiver prongs to pivot about an orientation axis and about a storage axis as shown in FIGS. 4-6;

FIG. 2 is a front elevation view of the child monitoring system of FIG. 1 showing that the transmitter unit included in the nursery station includes a microphone, a housing encasing the microphone, a nightlight coupled to the housing, and a plurality of controls extending out of the housing and showing that the receiver unit included in the caregiver remote includes a speaker, a housing encasing the speaker, a plurality of sound level indicator lights, and a plurality of controls extending out of the housing;

FIG. 3 is a rear elevation view of the child monitoring system of FIGS. 1 and 2 showing that the pivot hub of the nursery station and the pivot hub of the caregiver remote each includes a rotor coupled to a corresponding housing for movement about the orientation axis and a prong-support trunion coupled to the rotor for movement about the storage axis so that the power-receiver prongs are supported for movement relative to the corresponding housing as suggested in FIGS. 4-6;

FIG. 4 is a detail perspective view of the pivot hub included in the nursery station showing the power-receiver prongs in a storage position in which the power-receiver prongs extend along the housing of the nursery station and are received in channels formed in the rotor prior to movement of the power-receiver prongs about the storage axis so that the power-receiver prongs extend away from the housing as shown in FIG. 5 and before movement of the power-receiver prongs about the orientation axis as shown in FIG. 6;

FIG. 5 is a view similar to FIG. 4 showing the power-receiver prongs in a use position in which the power-receiver prongs extend away from the housing included in the nursery station so that the power-receiver prongs can be inserted into a wall socket and showing the power-receiver prongs in a longitudinally-oriented position in which the power-receiver prongs support the housing in a substantially vertical orientation to cause the housing to cover an adjacent wall socket blocking a child from putting fingers or objects into the adjacent wall socket before movement of the power-receiver prongs about the orientation axis to a laterally-oriented position as shown in FIG. 6;

FIG. 6 is a view similar to FIGS. 4 and 5 showing the power-receiver prongs in the use position and moved about the orientation axis to the laterally-oriented position so that the power-receiver prongs can be inserted into a wall socket to support the housing of the nursery station in a substantially horizontal orientation to uncover an adjacent wall socket to allow another electrical device to be plugged into the adjacent wall socket as shown in the lower left hand corner of in FIG. 1;

FIG. 7 is an exploded perspective view of the child monitoring system of FIGS. 1-3 showing that the nursery station includes a control board coupled to the microphone, the nightlight, and the plurality of control buttons included in the transmitter unit, showing that the caregiver remote includes a control board coupled to the speaker, the sound level indicator lights, and the plurality of control buttons included in the receiver unit, and showing that the caregiver remote includes a rechargeable battery unit coupled to the power-receiver prongs; and FIG. 8 is a rear perspective view of another child monitoring system similar to the child monitoring system of FIGS. 1-8 showing that the child monitoring system includes round power-receiver prongs sized to be received in a depression formed in a back plate of a corresponding housing when the power-receiver prongs are in the storage position.

DETAILED DESCRIPTION

An illustrative child monitoring system 10 for remotely supervising a child in a nursery includes a nursery station (sometimes called a baby unit) 12 and a caregiver remote (sometimes called a parent unit) 14 as shown in FIG. 1. Nursery station 12 is adapted to be installed in nursery 15 to sense and transmit sounds from nursery 15. Caregiver remote 14 is adapted to be carried with a caregiver outside nursery 15 to receive and reproduce sounds sensed by nursery station 12 so that the caregiver can listen to the child without entering nursery 15.

Nursery station 12 includes a transmitter unit 20, power-receiver prongs 30, and a pivot hub 40 as shown in FIG. 1. Transmitter unit 20 is adapted to sense and transmit sounds from nursery 15. Power-receiver prongs 30 of nursery station 12 are illustratively parallel left and right prongs 31, 32 adapted to plug into a wall outlet 35 to power transmitter unit 20. Pivot hub 40 of nursery station 12 is coupled between transmitter unit 20 and prongs 31, 32 and is adapted to allow prongs 31, 32 to pivot about an orientation axis 34 and about a storage axis 36 as suggested by arrows 34A and 36A in FIG. 1 and in FIGS. 4-6.

Caregiver remote 14 includes a receiver unit 50, power-receiver prongs 30, and a pivot hub 40 as shown in FIG. 1. Receiver unit 50 is adapted to receive and reproduce sounds from nursery 15 transmitted by transmitter unit 20 of nursery station 12. Power-receiver prongs 30 of caregiver remote 14 are illustratively parallel left and right prongs 31, 32 adapted to plug into a wall outlet to power or recharge receiver unit 50. In general, power-receiver prongs 30 of caregiver remote 14 are the substantially the same as power-receiver prongs 30 of nursery station 12. Pivot hub 40 of carrier remote 14 is coupled between receiver unit 50 and prongs 31, 32 and is adapted to allow prongs 31, 32 to pivot about an orientation axis 34 and about a storage axis 36 as shown in FIG. 1. In all other respects, pivot hub 40 is the substantially the same as pivot hub 40 included in nursery station 12.

For ease of description, only the structure of pivot hub 40 included in nursery station 12 is further described below since the structure of pivot hub 40 included in nursery station 12 is substantially the same as pivot hub 40 included in caregiver unit 14 as shown in FIG. 7. Pivot hub 40 includes a rotor 41 and a prong-support trunnion 42. Rotor 41 is coupled to transmitter unit 20 for movement about the orientation axis 34 over 360 degrees of motion. Prong-support trunnion 42 is coupled to rotor 41 for movement about the storage axis 36 over 90 degrees of motion.

Rotor 41 includes a case 43 and a converter unit 44 as shown in FIG. 7. Case 43 houses converter unit 44 and is formed to include storage channels 48, 49 sized receive left and right prongs 31, 32 as shown in FIG. 4. Converter unit 44 is illustratively an AC/DC converter configured to convert alternating current (AC) power (typically provided by wall outlet 35) to direct current (DC) power.

Prong-support trunnion 42 is coupled to a corresponding case 43 included in a rotor 41 to provide rotative bearing engagement between each prong-support trunnion 42 and each case 43 as suggested in FIG. 7. Prong-support trunnion 42 includes a shaft 46 and prong couplers 47, 48. Shaft 46 is mounted for rotative bearing engagement with rotor 41 so that the shaft 46 rotates about storage axis 36. Prong couplers 47, 48 are each coupled to shaft 46 for rotation therewith and to prongs 31, 32 so that prongs 31, 32 extend from transmitter unit 20 via pivot hub 40 without an intervening wire that spaces prongs 31, 32 from transmitter unit 20. Prong couplers 47, 48 engage case 43 of rotor 41 to block movement past 90 degrees as suggested in FIG. 1.

In operation, prongs 31, 32 are movable about storage axis 36 from a storage position as shown in FIG. 4 to a use position as shown in FIG. 5. In the storage position, power-receiver prongs extend along a housing 52 included in receiver unit 50 and are received in channels 38, 39 as shown in FIG. 4. In the storage position, prongs 31, 32 are generally flush with a back surface of case 33 and of housing 52 so that nursery station 12 (or caregiver remote 14) is flattened for storage in a pocket or carrying in a hand. In the use position, prongs 31, 32 extend away from housing 52 as shown in FIG. 5 to be inserted into a wall outlet to power and/or recharge caregiver remote 14.

Prongs 31, 32 are also moveable about orientation axis 34 from a longitudinally-oriented position as shown in FIG. 5 to a laterally-oriented position as shown in FIG. 6. In the longitudinally-oriented position, prongs 31, 32 support 14 transmitter unit 20 of nursery station 12 (or receiver unit 50 of caregiver remote) when plugged into a first wall socket in a substantially vertical orientation to cover an adjacent second wall socket. The adjacent second wall socket is thereby inaccessible to a child so that the child cannot put fingers or other objects into the adjacent second wall socket. In the laterally-oriented position, prongs 31, 32 support transmitter unit 20 in a substantially horizontal orientation when plugged into a first wall socket to uncover an adjacent second wall socket. The adjacent second wall socket is thus accessible to allow another electrical device such as a lamp to be plugged into the adjacent second wall socket as shown by nursery station 12 in the lower left hand portion of FIG. 1. In some embodiments, nursery station 12 and caregiver remote 14 are sized so that both can be plugged into the same wall socket when prongs 31, 32 of both are in the laterally-oriented position.

Transmitter unit 20 of nursery station 12 illustratively includes a microphone 21, a housing 22, a nightlight 23, a plurality of controls 25, and a control board 26 as shown, for example, in FIG. 7. Microphone 21 is coupled to control board 26 and is adapted to sense sounds in nursery 15. Housing 22 encases microphone 21 and control board 26. Nightlight 23 is coupled to housing 22 and is adapted to be turned on and off to provide light in nursery 15. Controls 25 are coupled to control board 26 inside housing 22 and extend out of housing 22 to receive inputs from a caregiver. Control board 26 is coupled to converter unit 44 and distributes power to other components of transmitter unit 20. Control board 26 also processes and transmits sounds sensed by microphone 21. In some embodiments, transmitter unit 20 may also include a camera coupled to control board 26 for use in recording and transmitting pictures from nursery 15.

Housing 22 illustratively includes a front shell 61, a back shell 62, and a back plate 63 as shown in FIG. 7. Front shell 61 cooperates with back shell to define an internal space 64 of housing 22 that receives other components of transmitter unit 20. Front shell 61 is formed to include sound receiving apertures 65, 66 that allow sound to pass into internal space 64. Back shell 62 is formed to include a rearwardly-opening bore 67 that receives rotor 41 of pivot hub 40 so that rotor 31 is able to rotate relative to housing 22. Back plate 63 is coupled to back shell 62 and is formed to include a depression 68 arranged to extend forwardly toward internal space 64 as shown in FIG. 3.

Nightlight 23 illustratively includes LED lights 23A, 23B and a semi-transparent cover 70 as shown in FIG. 7. LED lights 23A, 23B are coupled to control board 26 and extend out of housing 22. Cover 70 is coupled to housing 22 and allows light from LED lights 23A, 23B to project light outside of housing 22.

Controls 25 include a power button 27 and a volume rocker 28 as shown in FIG. 2. Power button 27 turns transmitter unit 20 on and off. Volume rocker 28 pivots to increase or decrease sensitivity of microphone 21.

Receiver unit 50 of caregiver remote 14 illustratively includes a speaker 51, a housing 52, a rechargeable battery 86, sound intensity lights 54, a plurality of controls 55, and a control board 56 as shown, for example, in FIG. 7. Speaker 51 is coupled to control board 56 and is adapted to reproduce sounds from transmitter unit 20 included in nursery station 12. Housing 52 encases speaker 51 and control board 56. Rechargeable battery 86 is used to power receiver unit 50 when prongs 31, 32 are not plugged in. Sound intensity lights 54 include three LED lights 54A, 54B, 54C that are lit in sequence to indicate the intensity of sound sensed by receiver unit 50. Controls 55 are coupled to control board 56 inside housing 52 and extend out of housing 52 to receive inputs from a caregiver. Control board 56 is coupled to converter unit 44 included in pivot hub 40 and distributes power to other components of receiver unit 50 (including rechargeable battery 86). Control board 56 also receives, processes, and reproduces sounds from transmitter unit 20 via speaker 51. In some embodiments, receiver unit 50 may also include a display coupled to control board 56 for use in displaying pictures provided by a camera in nursery 15.

Housing 52 illustratively includes a front shell 71, a back shell 72, and a back plate 73, as shown in FIG. 7. Front shell 71 cooperates with back shell to define an internal space 74 of housing 52 that receives other components of receiver unit 50. Front shell 71 is formed to include sound receiving apertures 75, 76 that allow sound to pass into internal space 74. Back shell 72 is formed to include a rearwardly-opening bore 77 that receives rotor 41 of pivot hub 40 so that rotor 41 is able to rotate relative to housing 52. Back plate 73 is coupled to back shell 72 and is formed to include a depression 78 arranged to extend forwardly toward internal space 74 as shown in FIG. 3. A cap 53 closes the top of housing 52.

Caregiver remote 14 also includes a kick stand 85 as shown in FIGS. 1 and 7. Kick stand 85 is coupled to back shell 72 and pivots about a stand axis 85A from a stowed position extending along back shell 72 to a use position extending at an angle away from back shell 72. In the use position, the kick stand 85 cooperates with the housing 52 so that caregiver remote 14 is self-supporting when placed upright on a flat surface. In other embodiments, caregiver remote 14 may include a belt clip coupled to housing 52 so that caregiver remote 14 can be attached to a caregiver's belt.

Controls 55 include a power button 57, a volume rocker 58, and a nightlight switch 59 as shown in FIG. 2. Power button 57 turns receiver unit 50 on and off. Volume rocker 58 pivots to increase or decrease volume of speaker 51. Nightlight switch 59 is adapted to turn nightlight 23 of nursery unit 12 on or off.

Another illustrative child monitoring system 210 is shown in FIG. 8. Child monitoring system 210 is substantially similar to the child monitoring system 10 shown in FIGS. 1-7 and described herein. Accordingly, similar reference numbers in the 200 series indicate features that are common between the child monitoring system 10 and the child monitoring system 210. The description of the child monitoring system 10 is hereby incorporated by reference to apply to child monitoring system 210, except in instances when it conflicts with the specific description and drawings of child monitoring system 210.

Unlike child monitoring system 10, child monitoring system 210 includes round power-receiver prongs 230 rather than rectangular power-receiver prongs 30 as shown in FIG. 8. Prongs 230 are sized to extend from pivot hub 240 into depression 278 formed in a back plates 273 of nursery station 212 and caregiver remote 214 when the power-receiver prongs 230 are in the storage position.

The invention claimed is:

1. A nursery station for a child monitoring system, the nursery station comprising a unit adapted to transmit or receive sounds from a nursery, power-receiver prongs coupled to the unit to conduct power from a wall socket to the unit when the power-receiver prongs are plugged into a wall outlet, and pivot means coupled between the unit and the power-receiver prongs for allowing rotation of the power-receiver prongs relative to the unit about an orientation axis from a longitudinally-oriented position, in which the power-receiver prongs are arranged to support the unit relative to a first wall socket such that an adjacent second wall socket is covered when the power-receiver prongs are plugged into the first wall socket, to a laterally-oriented position, in which the power-receiver prongs are arranged to support the unit relative to the first wall socket such that an adjacent second wall socket is uncovered when the power-receiver prongs are plugged into the first wall socket, so that a caregiver can block access to the second wall socket when the second wall socket is not needed or allow access to the second wall socket when another device is to be plugged into the second wall socket while maintaining a connection between the power-receiver prongs and the first wall socket when the power-receiver prongs are plugged into the second wall socket.

2. The nursery station of claim 1, wherein the pivot means further allows rotation of the power-receiver prongs relative to the unit about a storage axis from a storage position arranged to extend along the unit so that the power-receiver prongs are out of the way during transportation of the unit to a use position arranged to extend away from the unit so that the power-receiver prongs can be inserted into a wall socket.

3. The nursery station of claim 2, wherein the pivot means includes a rotor coupled to the unit for movement about the orientation axis and a prong-support trunion coupled to the rotor for movement with the rotor about the orientation axis, the prong-support trunion is also coupled to the rotor for movement about the storage axis, and the power-receiver prongs are coupled to the prong-support trunion for movement with the prong-support trunion for movement about the orientation axis and about the storage axis.

4. The nursery station of claim 3, wherein the prong-support trunion includes a shaft mounted for rotative bearing engagement with the rotor to allow movement of the prong-support trunion relative to the rotor about the storage axis and a plurality of prong couplers that are each coupled to the shaft for movement with the shaft about the storage axis and that are each coupled to a corresponding power-receiver prong.

5. The nursery station of claim 4, wherein the rotor is formed to include a plurality of channels sized and arranged to receive the power-receiver prongs when the power-receiver prongs are in the storage position and the prong couplers are sized to engage the rotor when the power-receiver prongs are in the storage position and when the power-receiver prongs are in the use position to block the power-receiver prongs from rotation of more than 90 degrees during movement between the storage position and the use position.

6. The nursery station of claim 1, wherein the pivot means includes a case and a converter unit both mounted to the unit for rotation about the orientation axis, the case houses the converter unit, and the converter unit is configured to convert alternating current power to direct current power.

7. The nursery station of claim 2, wherein the storage axis is perpendicular to the orientation axis and the storage axis is spaced apart from the orientation axis so that the storage axis does not intersect with the orientation axis.

8. A nursery station for a child monitoring system, the nursery station comprising a unit adapted to transmit or receive sounds from a nursery, power-receiver prongs coupled to the unit to conduct power from a wall socket to the unit when the power-receiver prongs are plugged into a wall outlet, and a pivot hub coupled to the unit to pivot relative to the unit about an orientation axis and coupled to the power-receiver prongs such that the power-receiver prongs pivot with the pivot hub relative to the unit about the orientation axis, wherein the pivot hub and the power-receiver prongs are movable about the orientation axis from a longitudinally-oriented position, in which the power-receiver prongs are arranged to support the unit relative to a first wall socket such that an adjacent second wall socket is covered when the power-receiver prongs are plugged into the first wall socket, and a laterally-oriented position, in which the power-receiver prongs are arranged to support the unit relative to a first wall socket such that an adjacent second wall socket is uncovered when the power-receiver prongs are plugged into the first wall socket.

9. The nursery station of claim 8, wherein the power-receiver prongs are mounted for movement relative to the unit about a storage axis that extends perpendicular to the orientation axis and the power-receiver prongs are movable between a storage position arranged to extend along the unit and a use position arranged to extend away from the unit.

10. The nursery station of claim 9, wherein the pivot hub includes a rotor coupled to the unit for rotation about the orientation axis and a prong-support trunion coupled to the rotor for rotation with the rotor about the orientation axis, the prong-support trunion is mounted to the rotor in rotative bearing engagement for rotation about the storage axis, and the power-receiver prongs are coupled to the prong-support trunion for rotation with the prong-support trunion about the orientation axis and about the storage axis.

11. The nursery station of claim 9, wherein the power-receiver prongs are received in corresponding channels formed in the pivot hub when the power-receiver prongs are in the storage position.

12. The nursery station of claim 8, wherein the pivot hub includes a converter unit configured to convert alternating current power to direct current power and the converter unit rotates with the pivot hub and the power-receiver prongs about the orientation axis between the longitudinally-oriented position and the laterally-oriented position.

13. The nursery station of claim 12, wherein the pivot hub includes a case that houses the converter unit and a prong-support trunion coupled to the case for rotation with the case about the orientation axis, the prong-support trunion is mounted to the case for rotation about a storage axis, and the power-receiver prongs are coupled to the prong-support trunion for rotation with the prong-support trunion about the orientation axis and about the storage axis.

* * * * *